US012648627B2

(12) United States Patent
Chang et al.

(10) Patent No.: US 12,648,627 B2
(45) Date of Patent: Jun. 9, 2026

(54) WEARABLE DEVICE AND UPPER HEAD STRAP MODULE

(71) Applicant: HTC Corporation, Taoyuan City (TW)

(72) Inventors: Chih-Yao Chang, Taoyuan City (TW); Tsen-Wei Kung, Taoyuan City (TW); Chung-Ju Wu, Taoyuan City (TW); Tsung-Hua Yang, Taoyuan City (TW); Chien Min Lin, Taoyuan City (TW)

(73) Assignee: HTC Corporation, Taoyuan City (TW)

( * ) Notice: Subject to any disclaimer, the term of this patent is extended or adjusted under 35 U.S.C. 154(b) by 81 days.

(21) Appl. No.: 18/635,019

(22) Filed: Apr. 15, 2024

(65) Prior Publication Data

US 2024/0415246 A1 Dec. 19, 2024

Related U.S. Application Data

(60) Provisional application No. 63/521,096, filed on Jun. 15, 2023.

(51) Int. Cl.
*A44C 5/18* (2006.01)
*G02B 27/01* (2006.01)

(52) U.S. Cl.
CPC ..... *A44C 5/18* (2013.01)

(58) Field of Classification Search
CPC ... A44C 5/18; G02B 27/0176; Y10T 24/4736; Y10T 24/4782; Y10T 24/47; Y10T 24/4773; B60P 7/0823; B60P 7/0807
See application file for complete search history.

(56) References Cited

U.S. PATENT DOCUMENTS

| | | | | |
|---|---|---|---|---|
| 2,078,010 | A * | 4/1937 | Meepos | F41C 23/02 24/265 CD |
| 10,863,637 | B1 | 12/2020 | Pickett et al. | |
| 2013/0285886 | A1 | 10/2013 | Pombo et al. | |
| 2016/0069371 | A1 * | 3/2016 | Chen | A44B 11/263 29/446 |
| 2019/0028697 | A1 * | 1/2019 | Sullivan | H04N 13/344 |

FOREIGN PATENT DOCUMENTS

| | | |
|---|---|---|
| CN | 105739100 | 7/2016 |
| TW | 202307514 | 2/2023 |

OTHER PUBLICATIONS

"Office Action of Taiwan Counterpart Application", issued on Mar. 26, 2025, p. 1-p. 4.

* cited by examiner

*Primary Examiner* — Jack W Lavinder
(74) *Attorney, Agent, or Firm* — JCIPRNET

(57) ABSTRACT

A wearable device includes a host, a side head strap module, and an upper head strap module. The host has a sliding rail. The side head strap module is connected to the host. The upper head strap module includes a sliding base, a front buckle, and an upper head strap. The sliding base is detachably coupled to the sliding rail and slides along the sliding rail. The sliding rail has a first engaging part. The sliding base has a second engaging part. An engagement between the first engaging part and the second engaging part temporarily fixes the sliding base to the sliding rail. The front buckle is pivotally connected to the sliding base. The upper head strap is connected between the side head strap module and the front buckle. In addition, an upper head strap module applied to the wearable device is also proposed.

7 Claims, 8 Drawing Sheets

WEARABLE DEVICE AND UPPER HEAD STRAP MODULE

CROSS-REFERENCE TO RELATED APPLICATION

This application claims the priority benefit of U.S. provisional application Ser. No. 63/521,096, filed on Jun. 15, 2023. The entirety of the above-mentioned patent application is hereby incorporated by reference herein and made a part of this specification.

BACKGROUND

Technical Field

The disclosure relates to a wearable device, and in particular to a wearable device and an upper head strap module.

Description of Related Art

As the technology industry becomes increasingly developed, the types, functions and methods of use of display devices are becoming more and more diverse, and wearable display devices that can be directly worn on the body of the user have also emerged accordingly. There are many types of head-mounted display devices. Taking a glasses-type of the head-mounted display device as an example, after the user wears this type of display device, in addition to seeing three-dimensional images, the image also changes as the head of the user rotates, which may provide the user with a more immersive experience. However, when the user is playing games and the movements are too intense, a pair of temples of the glasses-type of the head-mounted display device may not provide sufficient clamping force. Therefore, an additional headband module assembled to an end of the temple may be provided to reduce the risk of the glasses-type of the head-mounted display device falling.

SUMMARY

The disclosure provides a wearable device on which the headband module can be installed, removed, or replaced according to the needs of the user.

The disclosure provides an upper head strap module, which is adaptable for a wearable device and can be installed, removed, or replaced according to the needs of the user.

A wearable device of the disclosure includes a host, a side head strap module, and an upper head strap module. The host has a sliding rail. The side head strap module is connected to the host. The upper head strap module includes a sliding base, a front buckle, and an upper head strap. The sliding base is detachably coupled to the sliding rail and slides along the sliding rail.

The sliding rail has a first engaging part. The sliding base has a second engaging part. An engagement between the first engaging part and the second engaging part temporarily fixes the sliding base to the sliding rail. The front buckle is pivotally connected to the sliding base. The upper head strap is connected between the side head strap module and the front buckle.

An upper head strap module of the disclosure is adaptable for a wearable device. The wearable device includes a host and a side head strap module. The host has a sliding rail. The side head strap module is connected to the host. The upper head strap module includes a sliding base, a front buckle, and an upper head strap. The sliding base is detachably coupled to the sliding rail and slides along the sliding rail. The sliding rail has a first engaging part. The sliding base has a second engaging part. An engagement between the first engaging part and the second engaging part temporarily fixes the sliding base to the sliding rail. The front buckle is pivotally connected to the sliding base. The upper head strap is connected between the side head strap module and the front buckle.

Based on the above, the upper head strap module may be used as an accessory of the wearable device and may be installed, removed, or replaced according to the needs of the user. Therefore, the upper head strap of the upper head strap module may be designed with different sizes and appearances, and so the user may choose the upper head strap module to be installed according to personal head shape and preferences.

DESCRIPTION OF THE EMBODIMENTS

Figure 1:
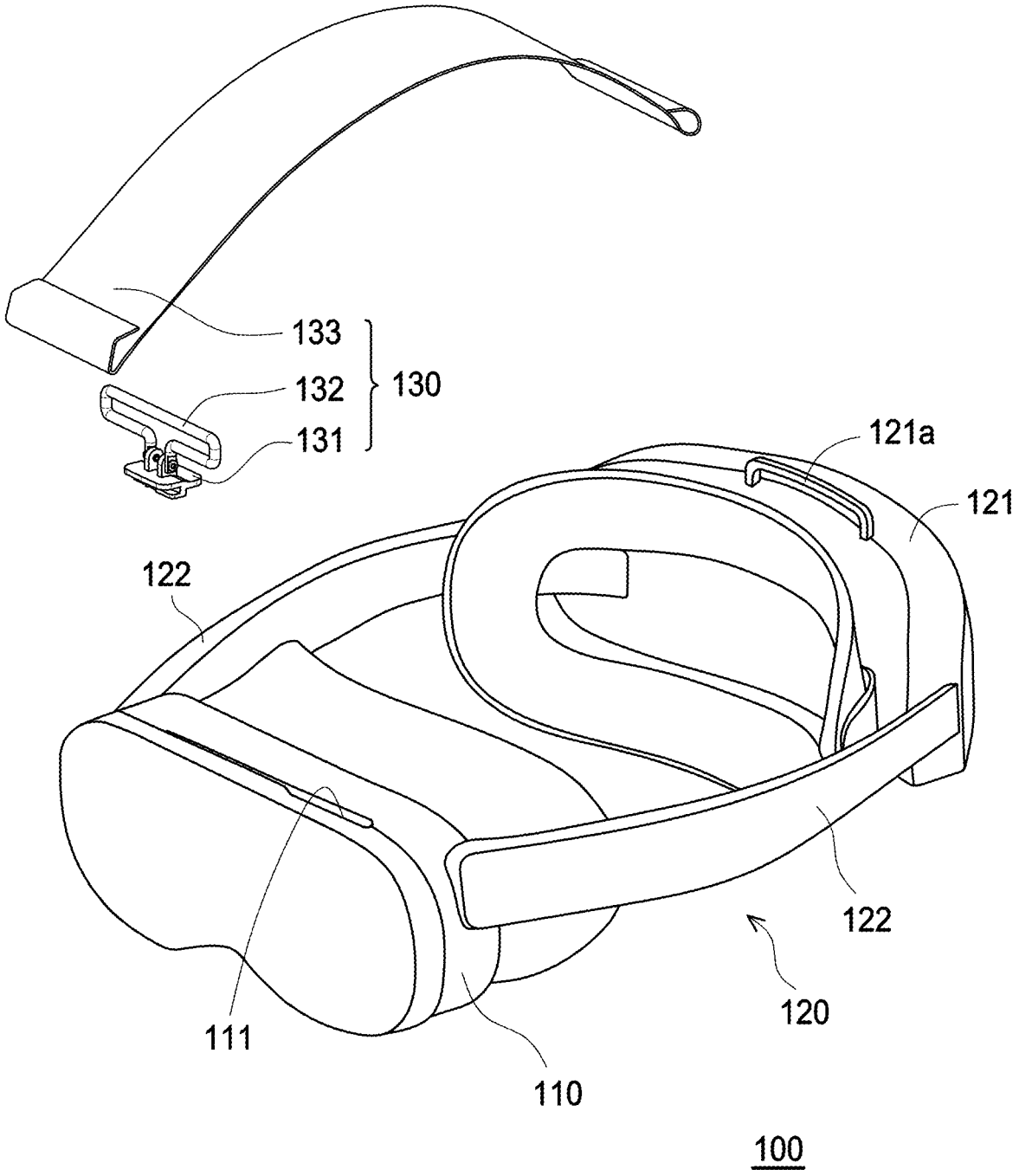
FIG. 1 is an exploded view of a wearable device and a headband module thereon according to an embodiment of the invention.
Figure 2:
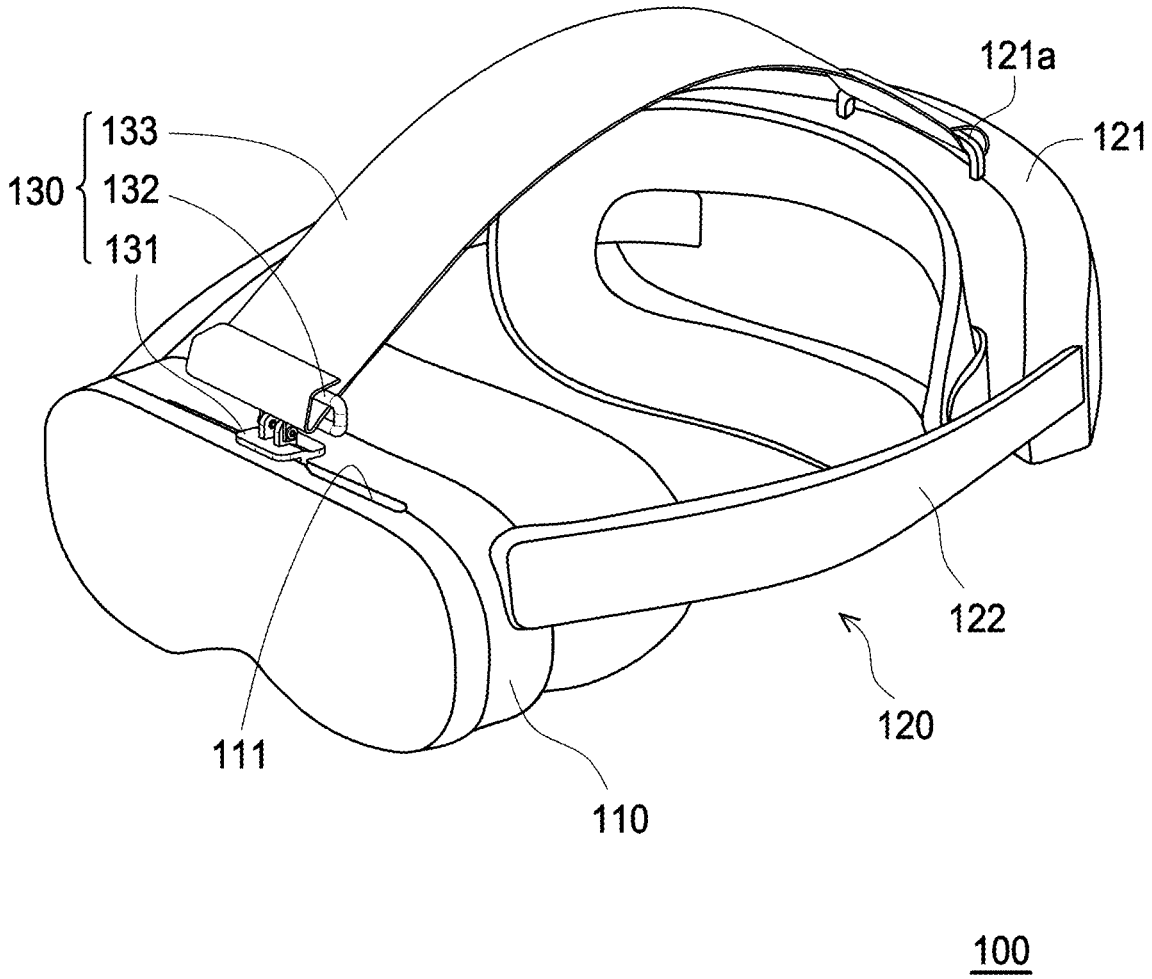
FIG. 2 is an assembly view of the wearable device and the headband module thereon in FIG. 1.

Please refer to FIG. 1 and FIG. 2. In this embodiment, a wearable device 100 includes a host 110. The host 110 is a head-mounted display, which may be applied in fields such as a virtual reality system, an augmented reality system, or a mixed reality system. The host 110 may include components such as an optical system and a protective housing, and may be provided with a display or adapted to place a display. The aforementioned display may be a built-in display or an external portable display (such as a smartphone, etc.), but the disclosure is not limited thereto. The optical system includes optical elements used to change a light path of the display, such as lenses, light guides, or prisms.

Please refer to FIG. 1 and FIG. 2. In this embodiment, the wearable device 100 further includes a side head strap module 120. The side head strap module 120 is connected to the host 110 to position the host 110 on the face of the user. In order to assist the stability of the host 110, a weight of the host 110 is shared, and the pressure exerted on the user by the side head strap module 120 is reduced. The wearable device 100 further includes an upper head strap module 130.

Figure 3:
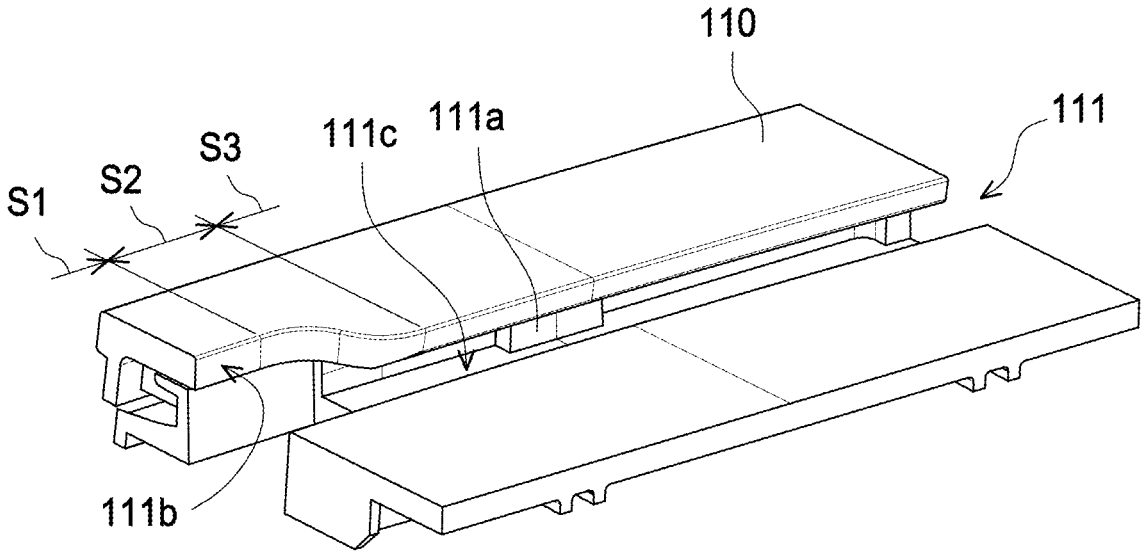
FIG. 3 is an enlarged view of a partial sliding rail of a host in FIG. 1 viewed from a rear side.
Figure 4:
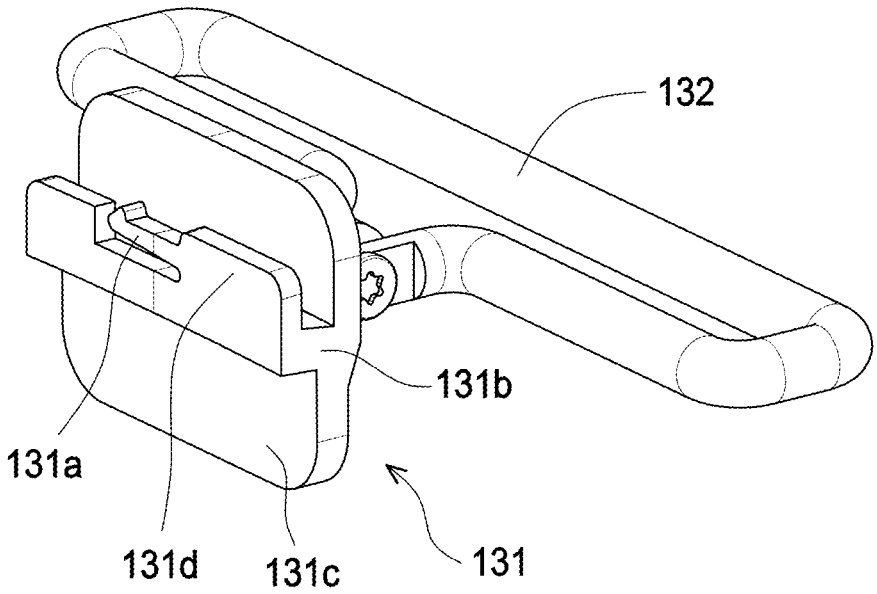
FIG. 4 is an enlarged view of a sliding base and a front buckle in FIG. 1 turned 90 degrees.

Please refer to FIG. 1, FIG. 2, FIG. 3, and FIG. 4. In this embodiment, the upper head strap module 130 includes a sliding base 131, a front buckle 132, and an upper head strap 133. The sliding base 131 is detachably coupled to the sliding rail 111 and slides along the sliding rail 111. The host 110 has a sliding rail 111. The sliding rail 111 has a first engaging part 111*a* (for example, a clamping block, as shown in FIG. 3). The sliding base 131 has a second engaging part 131*a* (for example, a hook, as shown in FIG. 4). The engagement between the first engaging part 111*a* and the second engaging part 131*a* temporarily fixes the sliding base 131 to the sliding rail 111. The front buckle 132 is pivotally connected to the sliding base 131. The upper head strap 133 is connected between the side head strap module 120 and the front buckle 132, as shown in FIG. 2.

Figure 5A:
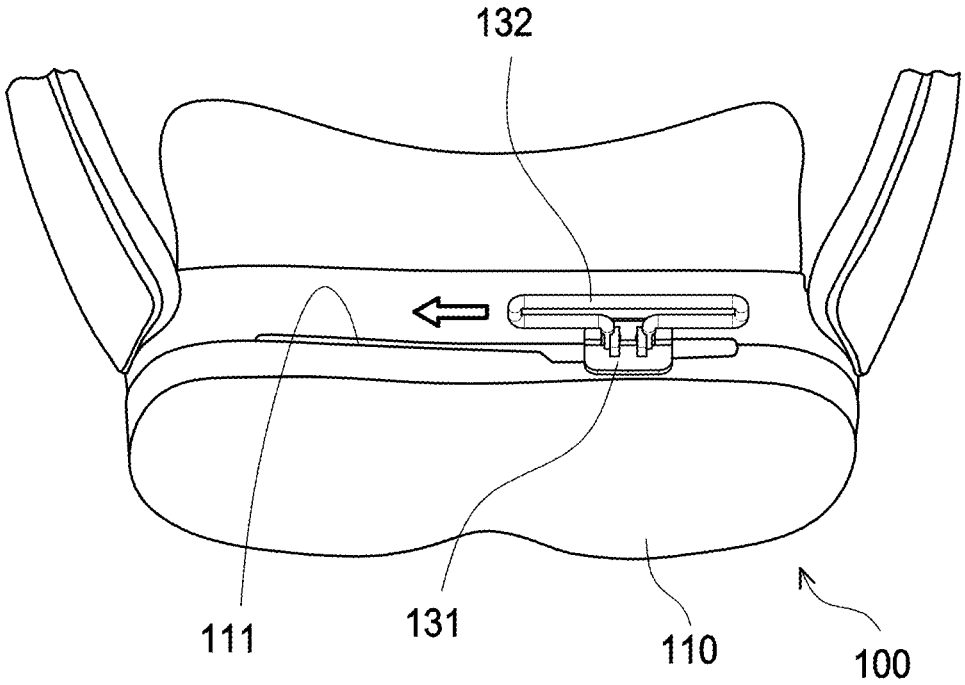
FIG. 5A and FIG. 5B are processes of installing the sliding base and the front buckle in FIG. 1 to the host respectively.
Figure 5B:
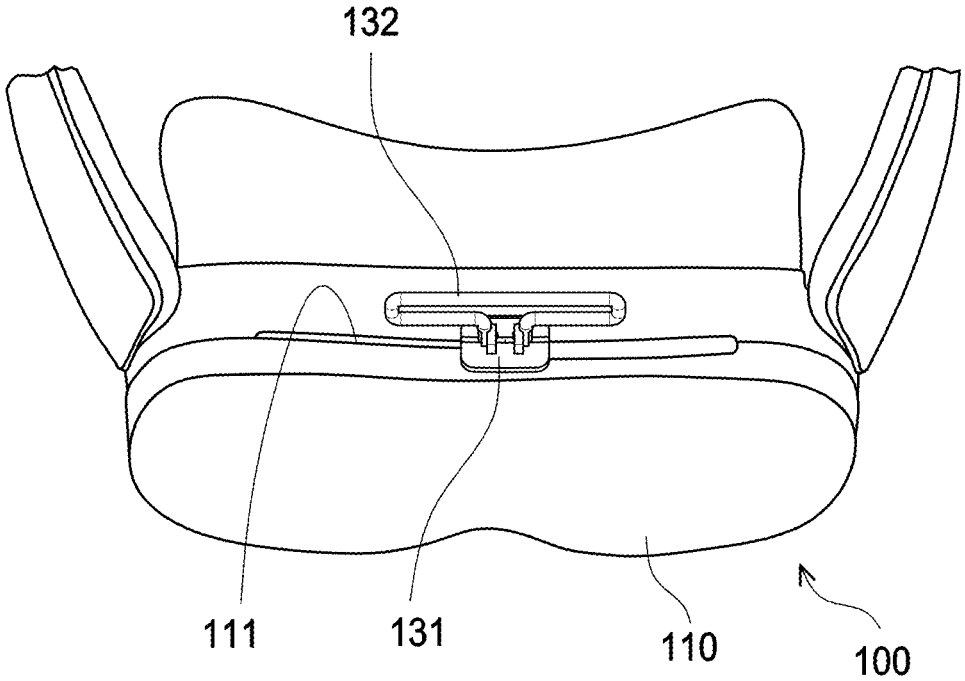

Please refer to FIG. 3, FIG. 5A, and FIG. 5B. In this embodiment, the sliding rail 111 may have a track slit 111*b*. The track slit 111*b* has an open section S1, a transition section S2, and a locking section S3. The open section S1 may be an original heat dissipation hole of the host 110. In other words, the original heat dissipation hole is used as a part of a fixed structure of the upper head strap module 130 without changing the appearance of the host 110 as much as possible. Specifically, the open section S1, the transition section S2, and the locking section S3 are connected in sequence. A width of the open section S1 may be greater than a width of the locking section S3. A length of the open section S1 and a length of the locking section S3 may be greater than a length of the transition section S2. The sliding base 131 may have a sliding part 131*b* (as shown in FIG. 4 and FIG. 7). Since the width of the open section S1 is greater than the width of the locking section S3, the sliding part 131*b* may enter the track slit 111*b* from the open section S1 of the track slit 111*b*. The sliding part 131*b* slides along the transition section S2 and the locking section S3 of the track slit 111*b* until the first engaging part 111*a* engages with the second engaging part 131*a*, as shown in FIG. 6A and FIG. 6B.

Please refer to FIG. 3, FIG. 4, and FIG. 7. In this embodiment, the sliding rail 111 may have a track groove 111*c*. The track groove 111*c* communicates with the track slit 111*b*. The sliding base 131 has a base part 131*c* and an anti-separation part 131*d*. The sliding part 131*b* is connected between the base part 131*c* and the anti-separation part 131*d*. The front buckle 132 is pivotally connected to the base part 131*c* of the sliding base 131. The anti-separation part 131*d* slides in the track groove 111*c* along the sliding part 131*b*. When the sliding part 131*b* slides along the locking section S3 of the track slit 111*b*, the cooperation between the anti-separation part 131*d* and the track groove 111*c* restricts the base part 131*c* from being disengaged from the sliding rail 111.

Figure 6A:
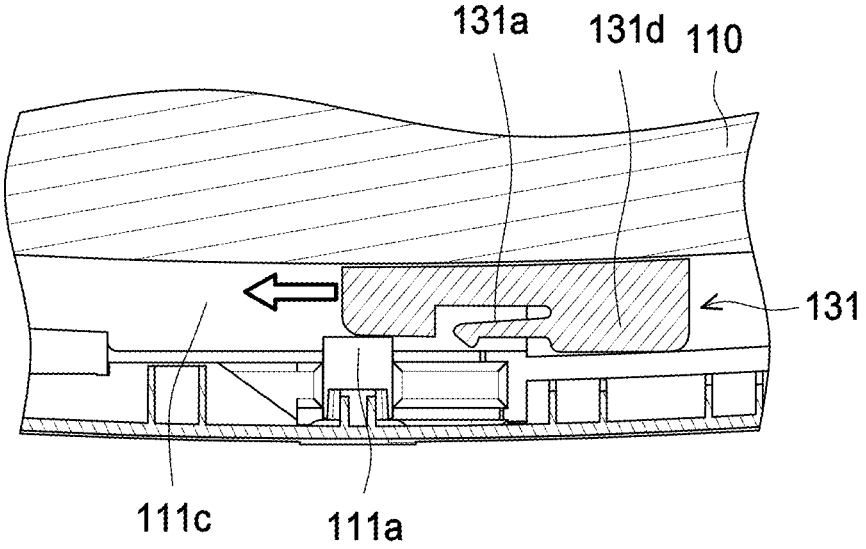
FIG. 6A and FIG. 6B are enlarged cross-sectional views of the sliding bases and the sliding rails in FIG. 5A and FIG. 5B respectively.
Figure 6B:
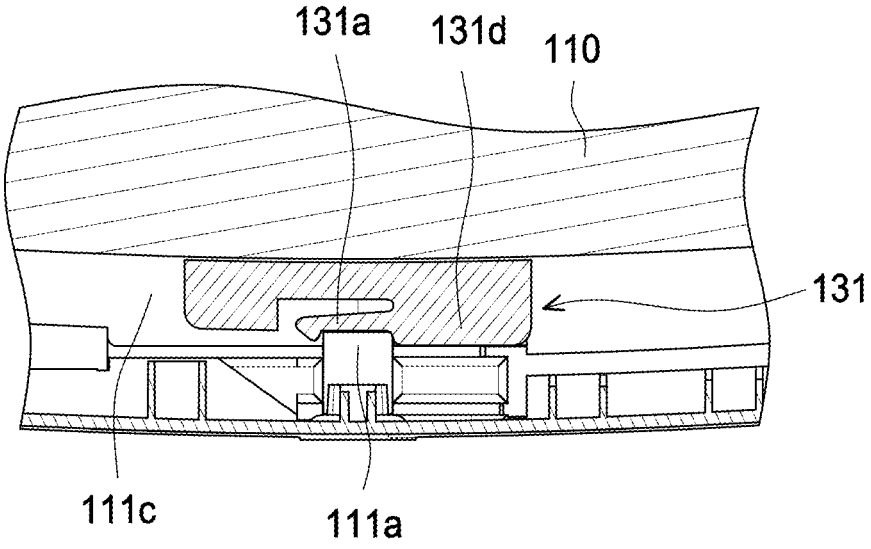
Figure 7:
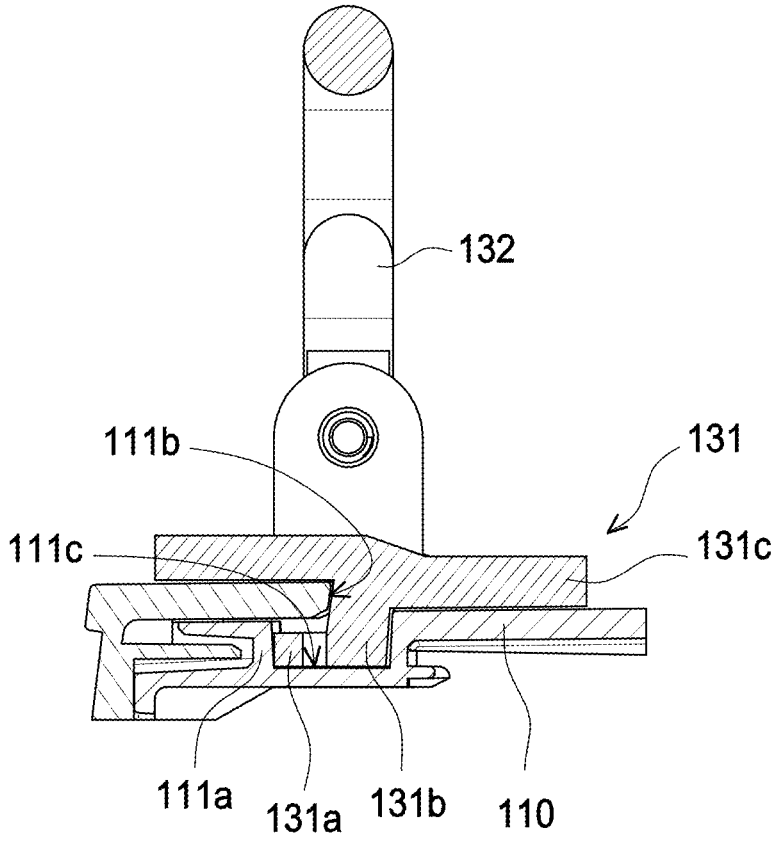
FIG. 7 is an enlarged longitudinal cross-sectional view of a sliding base and a sliding rail in FIG. 2.

Please refer to FIG. 6A, FIG. 6B, and FIG. 7. In this embodiment, if the sliding base 131 is planned to be disengaged from the sliding rail 111, the force is applied on the host 110 and the sliding base 131 to release the engagement between the first engaging part 111*a* and the second engaging part. 131*a*. Next, the sliding part 131*b* of the sliding base 131 slides from the locking section S3 (as shown in FIG. 3) of the track slit 111*b* to the open section S1 (as shown in FIG. 3) of the track slit 111*b*, so that the anti-separation part 131*d* no longer interlocks with the track groove 111*c* and may be disengaged upward from the open section S1 of the track slit 111*b*. At this time, the sliding base 131 may be disengaged from the sliding rail 111.

Please refer to FIG. 3, FIG. 4, and FIG. 7. The first engaging part 111*a* is located in the track groove 111*c*. The second engaging part 131*a* is elastically connected to the sliding part 131*b*. When the sliding part 131*b* slides along the locking section S3 of the track slit 111*b*, the second engaging part 131*a* is pushed by the first engaging part 111*a* relative to the track groove 111*c* until the second engaging part 131*a* engages with the first engaging part 111*a*.

In this embodiment, the side head strap module 120 may include a headrest 121 and a pair of side head straps 122. The pair of side head straps 122 are respectively connected between opposite sides of the host 110 and opposite sides of the headrest 121. The upper head strap 133 may be connected between the front buckle 132 and the headrest 121. Specifically, the headrest 121 may have a rear buckle 121*a*. Both ends of the upper head strap 133 may be connected to the rear buckle 121*a* and the front buckle 132 respectively through detachable connection means (for example, Velcro or buckles).

Figure 8:
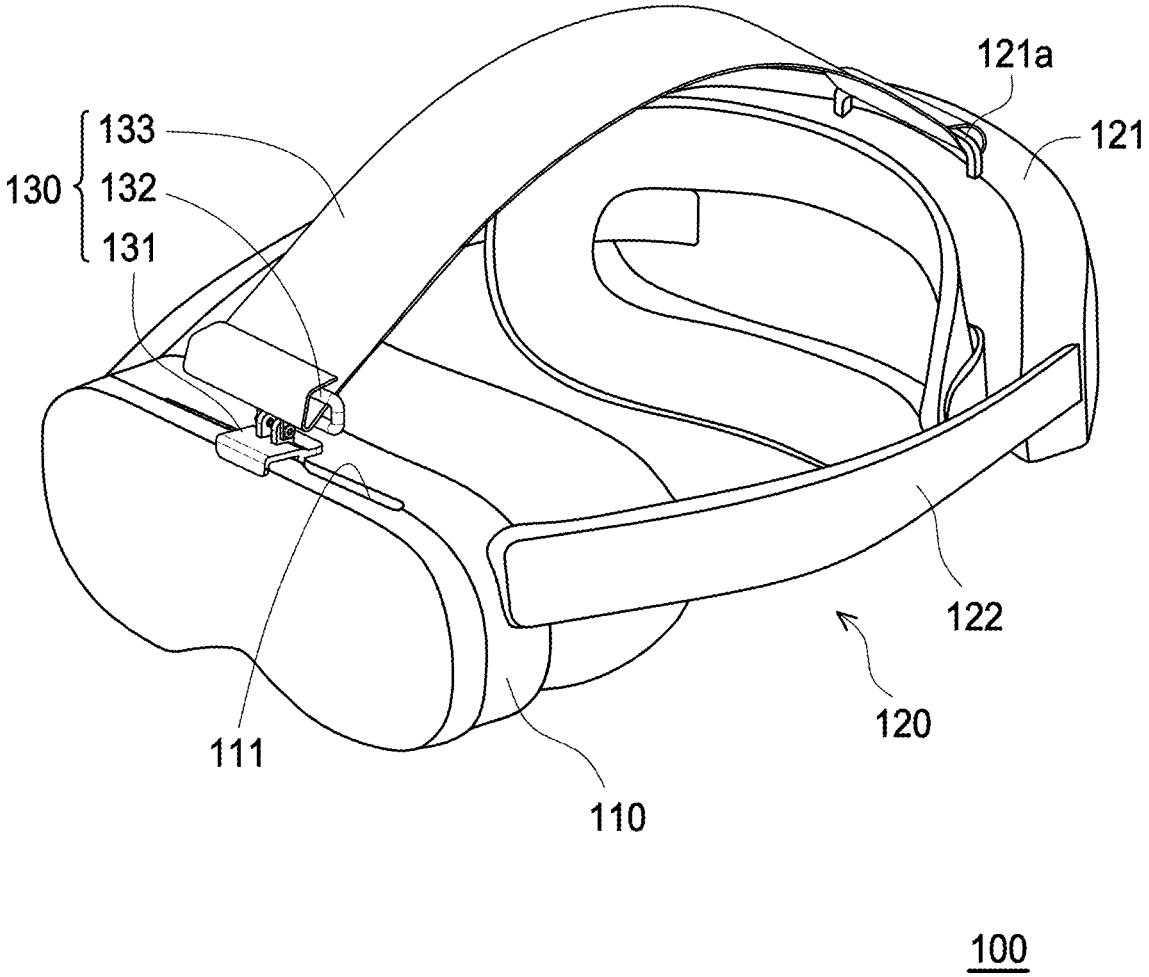
FIG. 8 is an assembly view of a wearable device and a headband module thereon according to another embodiment of the invention.
Figure 9:
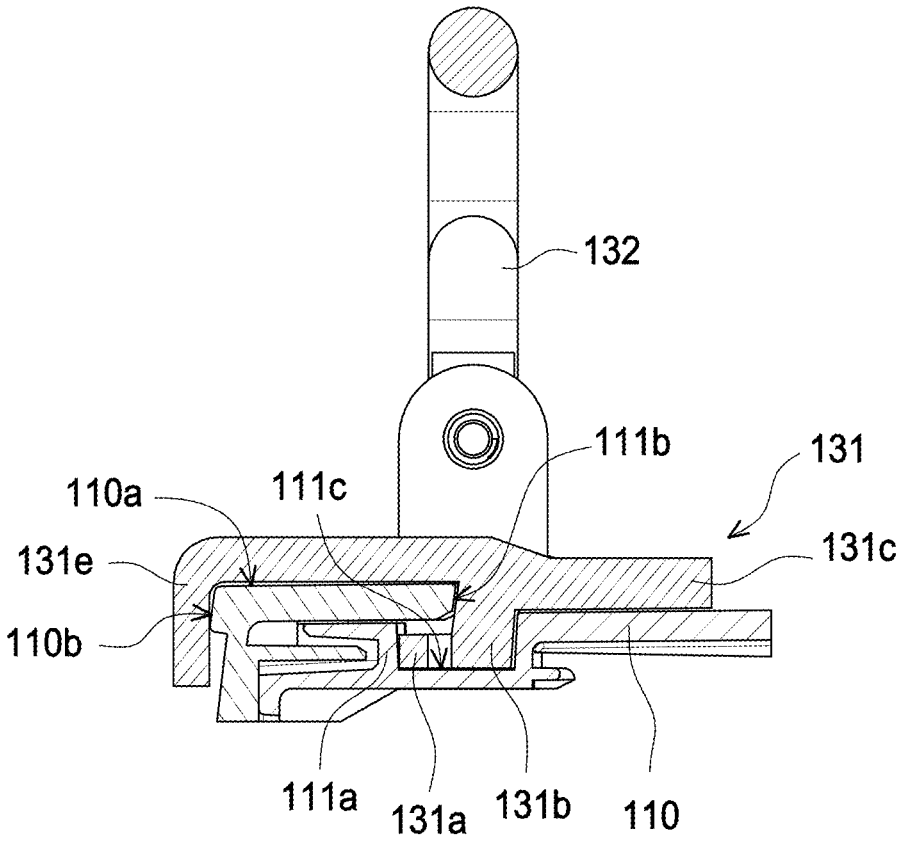
FIG. 9 is an enlarged longitudinal cross-sectional view of a sliding base and a sliding rail in FIG. 8.

Please refer to FIG. 8 and FIG. 9. The embodiments of FIG. 8 and FIG. 9 are similar to the embodiments shown in FIG. 1 and FIG. 7. The difference between the two lies in that the sliding base 131 of the embodiments of FIG. 8 and FIG. 9 may further have a limiting part 131*e*. The limiting part 131*e* is connected to the base part 131*c*. The limiting part 131*e* extends from a top surface 110*a* of the host 110 to a front surface 110*b* of the host 110. The first engaging part 111*a* and the second engaging part 131*a* are located between the sliding part 131*b* and the limiting part 131*e*. The limiting part 131*e* may restricts the base part 131*c* from being disengaged from the sliding rail 111.

In summary, an upper head strap module may be used as an accessory of a wearable device and may be installed, removed, or replaced according to the needs of the user. Therefore, an upper head strap of the upper head strap module may be designed with different sizes and appearances, and so the user may choose the upper head strap module to be installed according to personal head shape and preferences. In addition, an open section of a track slit may be an original heat dissipation hole of a host, so that the original heat dissipation hole may be used as a part of a fixed structure of the upper head strap module without changing the appearance of the host.

What is claimed is:

1. A wearable device, comprising:

a host, having a sliding rail;

a side head strap module, connected to the host and comprising a headrest; and an upper head strap module, comprising:

a sliding base, detachably coupled to the sliding rail and sliding along the sliding rail, wherein the sliding rail has a first engaging part, the sliding base has a second engaging part, and an engagement between the first engaging part and the second engaging part temporarily fixes the sliding base to the sliding rail;

a front buckle, pivotally connected to the sliding base; and an upper head strap, connected between the front buckle and the headrest, wherein the sliding rail has a track slit, the track slit has an open section, a transition section, and a locking section, the open section, the transition section, and the locking section are connected in sequence, the sliding base has a sliding part, the sliding part enters the track slit from the open section of the track slit, and the sliding part slides along the transition section and the locking section of the track slit until the first engaging part engages with the second engaging part, wherein the sliding rail has a track groove, the track groove communicates with the track slit, the sliding base has a base part and an anti-separation part, the sliding part is connected between the base part and the anti-separation part, the front buckle is pivotally connected to the base part of the sliding base, the anti-separation part slides in the track groove along the sliding part, and when the sliding part slides along the locking section of the track slit, a cooperation between the anti-separation part and the track groove restricts the base part from being disengaged from the sliding rail.

2. The wearable device according to claim 1, wherein the first engaging part is located in the track groove, the second engaging part is elastically connected to the sliding part, and when the sliding part slides along the locking section of the track slit, the second engaging part relative to the track groove is pushed by the first engaging part until the second engaging part engages with the first engaging part.

3. The wearable device according to claim 2, wherein the sliding base has a limiting part, the limiting part is connected to the base part, the limiting part extends from a top surface of the host to a front surface of the host, and the first engaging part and the second engaging part are located between the sliding part and the limiting part.

4. The wearable device according to claim 1, wherein the side head strap module further comprises:

a pair of side head straps, respectively connected between opposite sides of the host and opposite sides of the headrest, wherein the upper head strap is connected between the front buckle and the headrest.

5. An upper head strap module adaptable for a wearable device, wherein the wearable device comprises a host and a side head strap module, the host has a sliding rail, the side head strap module is connected to the host and comprises a headrest, and the upper head strap module comprises:

a sliding base, detachably coupled to the sliding rail and sliding along the sliding rail, wherein the sliding rail has a first engaging part, the sliding base has a second engaging part, and an engagement between the first engaging part and the second engaging part temporarily fixes the sliding base to the sliding rail;

a front buckle, pivotally connected to the sliding base; and an upper head strap, connected between the front buckle and the headrest, wherein the sliding rail has a track slit, the track slit has an open section, a transition section, and a locking section, the open section, the transition section, and the locking section are connected in sequence, the sliding base has a sliding part, the first engaging part enters the track slit from the open section of the track slit, and the sliding part slides along the transition section and the locking section of the track slit until the first engaging part engages with the second engaging part, wherein the sliding rail has a track groove, the track groove communicates with the track slit, the sliding base has a base part and an anti-separation part, the sliding part is connected between the base part and the anti-separation part, the front buckle is pivotally connected to the base part of the sliding base, the anti-separation part slides in the track groove along the sliding part, and when the sliding part slides along the locking section of the track slit, a cooperation between the anti-separation part and the track groove restricts the base part from being disengaged from the sliding rail.

6. The upper head strap module according to claim 5, wherein the first engaging part is located in the track groove, the second engaging part is elastically connected to the sliding part, and when the sliding part slides along the locking section of the track slit, the second engaging part relative to the track groove is pushed by the first engaging part until the second engaging part engages with the first engaging part.

7. The upper head strap module according to claim 6, wherein the sliding base has a limiting part, the limiting part is connected to the base part, the limiting part extends from a top surface of the host to a front surface of the host, and the first engaging part and the second engaging part are located between the sliding part and the limiting part.

* * * * *